United States Patent [19]

Maurice

[11] 4,311,608

[45] Jan. 19, 1982

[54] ALL PURPOSE CLEANER

[76] Inventor: Joe G. Maurice, 1208 Terrace Trail, Hurst, Tex. 76053

[21] Appl. No.: 195,175

[22] Filed: Oct. 8, 1980

[51] Int. Cl.[3] ..... C11D 1/14; C11D 1/22; C11D 1/72; C11D 1/831

[52] U.S. Cl. ..... 252/143; 252/142; 252/173; 252/174.15; 252/174.21; 252/174.22; 252/550; 252/553; 252/558; 252/559; 252/DIG. 14

[58] Field of Search ..... 252/173, 174.15, 174.21, 252/174.22, 142, 143, 550, 553, 558, 559, DIG. 14

[56] References Cited

U.S. PATENT DOCUMENTS

| | | | |
|---|---|---|---|
| 2,969,329 | 1/1961 | Heininger | 252/553 |
| 3,969,258 | 7/1976 | Carandang | 252/106 |
| 3,969,282 | 7/1976 | Kappler | 252/142 |
| 3,983,078 | 9/1976 | Collins | 252/540 |
| 3,985,670 | 10/1976 | Berg | 252/117 |
| 4,075,118 | 2/1978 | Gault | 252/135 |

*Primary Examiner*—Dennis L. Albrecht
*Attorney, Agent, or Firm*—Arthur F. Zobal

[57] ABSTRACT

A cleaning solution consisting essentially of isopropyl alcohol, linear dodecylbenzene sulfonic acid, a primary alcohol containing 9 to 11 carbon atoms and an average of about 6 moles of ethylene oxide per mole of alcohol, a primary alcohol containing 9 to 11 carbon atoms and an average of about 2.5 moles of ethylene oxide per mole of alcohol, sodium lauryl sulfate and dy-methol poly siloxane emulsified in water.

2 Claims, No Drawings

ALL PURPOSE CLEANER

BACKGROUND OF THE INVENTION

Field of the Invention

The present invention relates to an all purpose cleaner for cleaning floors, appliances, toilet bowls, carpets, etc.

SUMMARY OF THE INVENTION

It is an object of the present invention to provide a new and useful all purpose cleaner. The cleaner comprises a solution consisting essentially of isopropyl alcohol, linear dodecylbenzene sulfonic acid, a primary alcohol containing 9 to 11 carbon atoms and an average of about 6 moles of ethylene oxide per mole of alcohol, a primary alcohol containing 9 to 11 carbon atoms and an average of about 2.5 moles of ethylene oxide per mole of alcohol, sodium lauryl sulfate, and dy-methol poly siloxane emulsified in water.

In a further aspect, a given amount of the solution contains about 6.25% to 18.75% of isopropyl alcohol, about ½% to 1.5% of linear dodecylbenzene sulfonic acid, about 4.5% to 12.5% of a primary alcohol containing 9 to 11 carbon atoms and an average of about 6 moles of ethylene oxide per mole of alcohol, about 4.5% to 12.5% of a primary alcohol containing 9 to 11 carbon atoms and an average of about 2.5 moles of ethylene oxide per mole of alcohol, about 43.75% to 70% of sodium lauryl sulfate and not more than about 4.5% of dy-methol siloxane emulsified in water.

DESCRIPTION OF THE PREFERRED EMBODIMENT

The all purpose cleaner of the present invention has been very effective in cleaning kitchen floors, appliances, toilet bowls, shower doors, carpets and many other items. It is a solution consisting essentially of 99% pure isopropyl alcohol, linear dodecylbenzene sulfonic acid (trade name Calsoft LAS-99), a primary alcohol containing 9 to 11 carbon atoms and an average of 6 moles of ethylene oxide per mole of alcohol (trade name Neodol 91-6), a primary alcohol containing 9-11 carbon atoms and an average of about 2.5 moles of ethylene oxide per mole of alcohol (trade name Neodol 91-2.5), 30% sodium lauryl sulfate (trade name Sulfotex WA) and dy-methol poly siloxane emulsified in water (trade name AF72).

The isopropyl alcohol acts as a thinner for the other chemicals of the cleaner preventing them from forming into a jell or slurry. It also has a small amount of cleaning power for tar substances. Calsoft LAS-99 is a form of sulfonic acid produced by Pilot Chemical Company. It acts to dissolve mineral deposits and stains. Neodol 91-6 and Neodol 91-2.5 both are primary alcohols produced by Shell Chemical Company. Neodol 91-6 is a water base wetting agent having more affinity for water soluble stains. Neodol 91-2.5 is an oil base wetting agent having more affinity for oil soluble stains. Sulfotex WA is a 30% solution of sodium lauryl sulfate made by Textilana, a division of Henkel, Inc. It is a soap or mild cleaning agent. AF72 is a silicone defoaming agent also made by Textilana, a division of Henkel, Inc.

In the preferred embodiment a given amount of the cleaning solution of the present invention contains the following percentages of the chemicals. In this embodiment, the weight of the solution is set at 128 ozs.

| | | |
|---|---|---|
| Isopropyl alcohol (99%) | 16 ozs., | 12.5% |
| Linear dodecylbenzene sulfonic acid | 1 oz., | .78125% |
| $C_9$–$C_{11}$ primary alcohol 6 mole ethoxylate | 8 ozs., | 6.25% |
| $C_9$–$C_{11}$ primary alcohol 2.5 mole ethoxylate | 8 ozs., | 6.25% |
| Sodium lauryl sulfate | 80 ozs., | 62.5% |
| Dy-methol poly siloxane emulsified in water | 3 ozs., | 2.34375% |
| Water | 12 ozs., | 9.375% |

The water is used to dilute the solution to a desired strength.

Although the above percentages are preferred, a concentrate of 128 ozs. of the solution with no water may contain the following percentages of the chemicals.

| | |
|---|---|
| Isopropyl alcohol (99%) | 6.25%–18.75% |
| Linear dodecylbenzene sulfonic acid | .5%–1.5% |
| $C_9$–$C_{11}$ primary alcohol 6 mole ethoxylate | 4.5%–12.5% |
| $C_9$–$C_{11}$ primary alcohol 2.5 mole ethoxylate | 4.5%–12.5% |
| Sodium lauryl sulfate | 43.75%–70% |
| Dy-methol poly siloxane emulsified in water | up to 4.5% |

For the above concentrate, sodium lauryl sulfate will be varied to make up the difference to form 128 ozs. depending upon the quantity of the other chemicals.

In some uses, the defoaming agent dy-methol poly siloxane emulsified in water is not needed. For example, if the cleaner is to be used only as a spot remover on carpets, the defoaming agent is not needed since the resulting foam could be wiped up. The defoaming agent will be needed in other uses for example, in cleaning appliances or as a spot remover on carpets followed by a soil extraction machine using steam.

The specification of linear dodecylbenzene sulfonic acid is as follows:

| | Maximum | Minimum | Typical |
|---|---|---|---|
| Sulfonic Acid: % | 99% | 97% | 97.5% |
| Acid Number (MgKOH/gm.) | 190 | 180 | 185 |
| Sulfuric Acid: % | 1.5% | 0.5% | 0.9% |
| Density (lbs./gallon) | 8.9 | 8.8 | 8.83 |
| Typical inspections of linear dodecylbenzene sulfonic acid are as follows: | | | |
| Petroleum Ether Extract: % | | | 1.0% |
| Color (5% neutral solution) | | | 50 Klett |
| Viscosity (at 25° C.) | | | 1100 cps |

Neodol 91-6 is a rapidly biodegradable nonionic surfactant. It is an ethoxylated alcohol based on Shell's Neodol 91, a blend of $C_9$, $C_{10}$, and $C_{11}$ linear primary alcohols, and contains an average of 6 moles of ethylene oxide per mole of alcohol. Its typical properties are as follows:

| | |
|---|---|
| Average molecular weight | 424 |
| Alcohol carbon number range | $C_9$–$C_{11}$ |
| EO/Alcohol, mole/mole, average | 6 |
| EO content, % w | 62 |
| HLB number | 12.5 |
| Appearance, ambient temperature | Liquid |
| Melting range, °C. (°F.) | 6–9 (42–48) |
| Pour point, °C. (°F.) | 7 (45) |
| Specific gravity, | |
| 25/25° C. (77/77° F.) | 0.991 |
| 15.6/15.6° C. (60/60° F.) | 0.995 |
| Pounds/U.S. gallon, | |
| 25° C. (77° F.) | 8.24 |
| 15.6° C. (60° F.) | 8.30 |

-continued

| | |
|---|---|
| Coefficient of expansion, pounds/U.S. gal/°F. | 0.0033 |
| Viscosity, cSt at 37.8° C. (100° F.) | 23 |
| Flash point, Pensky-Martens Closed Cup °C. (°F.) | 168 (334) |
| Hydroxyl number, mgKOH/g | 132 |
| Water, % w | 0.1 |
| Color (APHA), Pt-Co | 20 |
| Ash, % w | 0.1 |
| pH, 1% solution is distilled water | 6.0 |
| Cloud point, 1% solution, °C. (°F.) | 52 (126) |

Neodol 91-2.5 is a rapidly biodegradable nonionic surfactant. It is an ethoxylated alcohol based on Shell's Neodol 91, a blend of $C_9$, $C_{10}$, and $C_{11}$ linear primary alcohols, and contains an average of 2.5 moles of ethylene oxide per mole of alcohol. Its typical properties are as follows:

| | |
|---|---|
| Average molecular weight | 270 |
| Alcohol carbon number range | $C_9$–$C_{11}$ |
| EO/Alcohol, mole/mole, average | 2.5 |
| EO content, % w | 41 |
| HLB number | 8.1 |
| Appearance, ambient | Liquid |
| Pour point, °C. (°F.) | −12 (10) |
| Specific gravity, 25/25° C. (77/77° F.) | 0.934 |
| 15.6/15.6° C. (60.60° F.) | 0.929 |
| Pounds/U.S. gallon, 25° C. (77° F.) | 7.73 |
| 15.6° C. (60° F.) | 7.78 |
| Coefficient of expansion, pounds/U.S. gal/°F. | 0.0032 |
| Viscosity, cSt at 37.8° C. (100° F.) | 12 |
| Flash point, Pensky-Martens Closed Cup, °C. (°F.) | 138 (280) |
| Hydroxyl number, mgKOH/g | 208 |
| Water, % w | 0.1 |
| Color (APHA), Pt-Co | 20 |
| Ash, % w | 0.1 |
| pH, 1% agitated dispersion in distilled water | 6.0 |

-continued

| | |
|---|---|
| Solubility in water | Partial |

A typical analysis of Sulfotex WA is as follows:

| | |
|---|---|
| Color | White to straw |
| Odor | Faintly fatty |
| Viscosity | 500 cps. at 100° F. |
| Equivalent Na salt | 28% minimum |
| Alcohols sulfated | 18.5% minimum |
| Alcohols unsulfated | 1.5–2.5% |
| Alcohol insolubles | 2% max. |
| Chlorides (NaCl) | 0.3% max. |
| Iron | 10 ppm. max. |
| pH (10%) | 7.5–8.5 |
| Buffer action (Na20) | 0.1–0.2% |

I claim:

1. A cleaning solution consisting essentially of about 6.25% to 18.75% of isopropyl alcohol, about ½% to 1.5% of linear dodecylbenzene sulfonic acid, about 4.5% to 12.5% of a primary alcohol containing 9 to 11 carbon atoms and an average of about 6 moles of ethylene oxide per mole of alcohol, about 4.5% to 12.5% of a primary alcohol containing 9 to 11 carbon atoms and an average of about 2.5 moles of ethylene oxide per mole of alcohol, about 43.75% to 70% of sodium lauryl sulfate and not more than about 4.5% of dy-methol poly siloxane emulsified in water.

2. The cleaning solution of claim 1 wherein a given amount of said solution contains about 12.5% of isopropyl alcohol, about 0.78125% of linear dodecylbenzene surfonic acid, about 6.25% of a primary alcohol containing 9 to 11 carbon atoms and an average of about 6 moles of ethylene oxide per mole of alcohol, about 6.25% of a primary alcohol containing 9 to 11 carbon atoms and an average of about 2.5 moles of ethylene oxide per mole of alcohol, about 62.5% of sodium lauryl sulfate, and about 2.34375% of dy-methol poly siloxane emulsified in water.

* * * * *